US005412816A

United States Patent [19]

Paterson et al.

[11] Patent Number: 5,412,816

[45] Date of Patent: May 9, 1995

[54] SURGICAL SCRUB SINK

[75] Inventors: Graham H. Paterson, Wilmington; Barry Bedwell, Bear, both of Del.

[73] Assignee: Speakman Company, Wilmington, Del.

[21] Appl. No.: 178,509

[22] Filed: Jan. 7, 1994

[51] Int. Cl.[6] ..... E03C 1/05

[52] U.S. Cl. ..... 4/623

[58] Field of Search ..... 4/623, 624

[56] References Cited

U.S. PATENT DOCUMENTS

| | | | |
|---|---|---|---|
| 1,234,643 | 7/1917 | Doyle et al. | 4/249 |
| 1,714,573 | 5/1929 | Sloan | 251/61.1 |
| 2,776,812 | 1/1957 | Colendar | 251/40 |
| 2,965,906 | 12/1960 | Mullett et al. | 4/624 |
| 3,298,037 | 1/1967 | Luther | 4/668 |
| 3,415,278 | 12/1968 | Yamamoto et al. | 137/607 |
| 3,505,692 | 4/1970 | Forbes | 4/623 |
| 3,575,640 | 4/1971 | Ishikawa | 4/623 X |
| 3,576,277 | 4/1971 | Blackmon | 222/1 |
| 3,585,652 | 6/1971 | Forbes et al. | 4/623 |
| 3,585,653 | 6/1971 | Forbes et al. | 4/623 |
| 3,724,001 | 4/1973 | Ichimori et al. | 4/623 |
| 3,904,167 | 9/1975 | Touch et al. | 4/623 X |
| 4,398,310 | 8/1983 | Lienhard | 4/623 |
| 4,606,085 | 8/1986 | Davies | 4/623 |
| 4,742,583 | 5/1988 | Yoshida et al. | 4/313 |
| 4,886,207 | 12/1989 | Lee et al. | 236/12.12 |
| 4,941,219 | 7/1990 | Van Marcke | 4/623 |
| 4,942,631 | 7/1990 | Rosa | 4/623 |
| 5,031,258 | 7/1991 | Shaw | 4/623 |
| 5,060,323 | 10/1991 | Shaw | 4/623 |
| 5,199,118 | 4/1993 | Cole et al. | 4/619 |

OTHER PUBLICATIONS

Speakman Health Care Mixing Valves brochure (Jan. 1990), 1 pg.

Speakman Sensorflo Faucets brochure (Feb. 1992), 23 pgs.

*Primary Examiner*—Robert M. Fetsuga

*Attorney, Agent, or Firm*—Connolly & Hutz

[57] ABSTRACT

A surgical scrub sink includes a faucet mounted over a tub with an electronically operated on/off mechanism for controlling the flow of water from the faucet into the tub. A short focus sensor is mounted at the tub and directs a beam toward the front of the tub at the height of the user's legs for detecting the presence and absence of a user in the immediate vicinity of the tub. The sensor is operatively connected to the on/off mechanism so as to turn on the faucet when the presence of the user is detected and turn off the faucet when the absence of a user is detected.

2 Claims, 3 Drawing Sheets

SURGICAL SCRUB SINK

BACKGROUND OF THE INVENTION

Surgical sinks are used in order to permit a surgeon to wash his hands prior to placement of the surgical gloves for later surgery. It is essential in order to maintain the sterile conditions that the surgeon not touch any object which might be unsterile. This has lead to various approaches for controlling the on and off operation of a faucet for the surgical sink which would not require the surgeon to physically touch any control knob for manipulating the faucet. Among the approaches that have been attempted is the utilization of an infrared sensor above or in the sink itself for detecting the surgeon's hands in the vicinity of the faucet such as disclosed in Rosa U.S. Pat. No. 4,942,631. A disadvantage with this approach, however, is that the faucet turns off when the surgeon's hands are moved away from the immediate vicinity of the faucet, although the washing operation has not been completed. It is then necessary to again turn on the faucet when the presence of the surgeon's hands is detected. This results an intermittent on and off action of the faucet.

Attempts to avoid the above problems have resulted in variations such as changing the beam of light in its length and scope so as to still detect the surgeon's hands when the hands are not in the immediate vicinity of the faucet. A disadvantage with this approach, however, is the detection of other objects in the beam of light causing false signals which result in the faucet being turned on even though the surgeon is not present. Other attempts have included utilizing foot operated pedals or stirrups which the surgeon would use to control actuation of the faucet. These approaches, however, are unsatisfactory in that they require actions to be taken by the surgeon when the most desirable condition would be for the surgeon to simply concentrate on a washing of the hands and not be concerned with controlling the on and off conditions of the faucet.

Another approach is illustrated in Blackmon U.S. Pat. No. 3,576,277 where hospital personnel are required to pass one hand through an electric eye mounted on the wall above the scrub sink to start and stop flow of hot and cold water. This arrangement has the disadvantage of placing the surgeon's hands in a nonsterile area around the electric eyes.

SUMMARY OF THE INVENTION

An object of this invention is to provide an automatically operated surgical scrub sink which overcomes the above disadvantages.

A further object of this invention is to provide such a surgical scrub sink which maintains the faucet on as long as the surgeon is in the immediate vicinity of the tub without requiring the surgeon's hands to be physically located at the faucet.

In accordance with this invention a surgical scrub sink includes a tub having a faucet mounted over and disposed toward it. An electronically operated on/off mechanism controls the flow of water from the faucet into the tub. A short focus sensor is mounted under or alongside the tub for directing a beam in front of the tub at the height of the user's legs so as to detect the presence and absence of a user in the immediate vicinity of the tub. The sensor is operationally connected to the on and off mechanism so as to comprise a control for turning on the faucet when the presence of the user is detected and turning off the faucet when the absence of a user is detected.

In a preferred practice of this invention the short focus sensor is used which is operative only over a focal distance of two to six inches so as to avoid false starts by detecting objects other than the surgeon standing in the immediate vicinity of the tub. A further preferred practice of the invention provides mounting the sensor on a support arm which extends below and generally to the front edge of the tub so as to assure properly locating the short focus sensor at its desired location. The support arm may be suspended from the tub by mounting the support arm to the tub drain pipe. The support arm may be used for mounting the mixing valve for the faucet.

THE DRAWINGS

DETAILED DESCRIPTION

Figure 1:
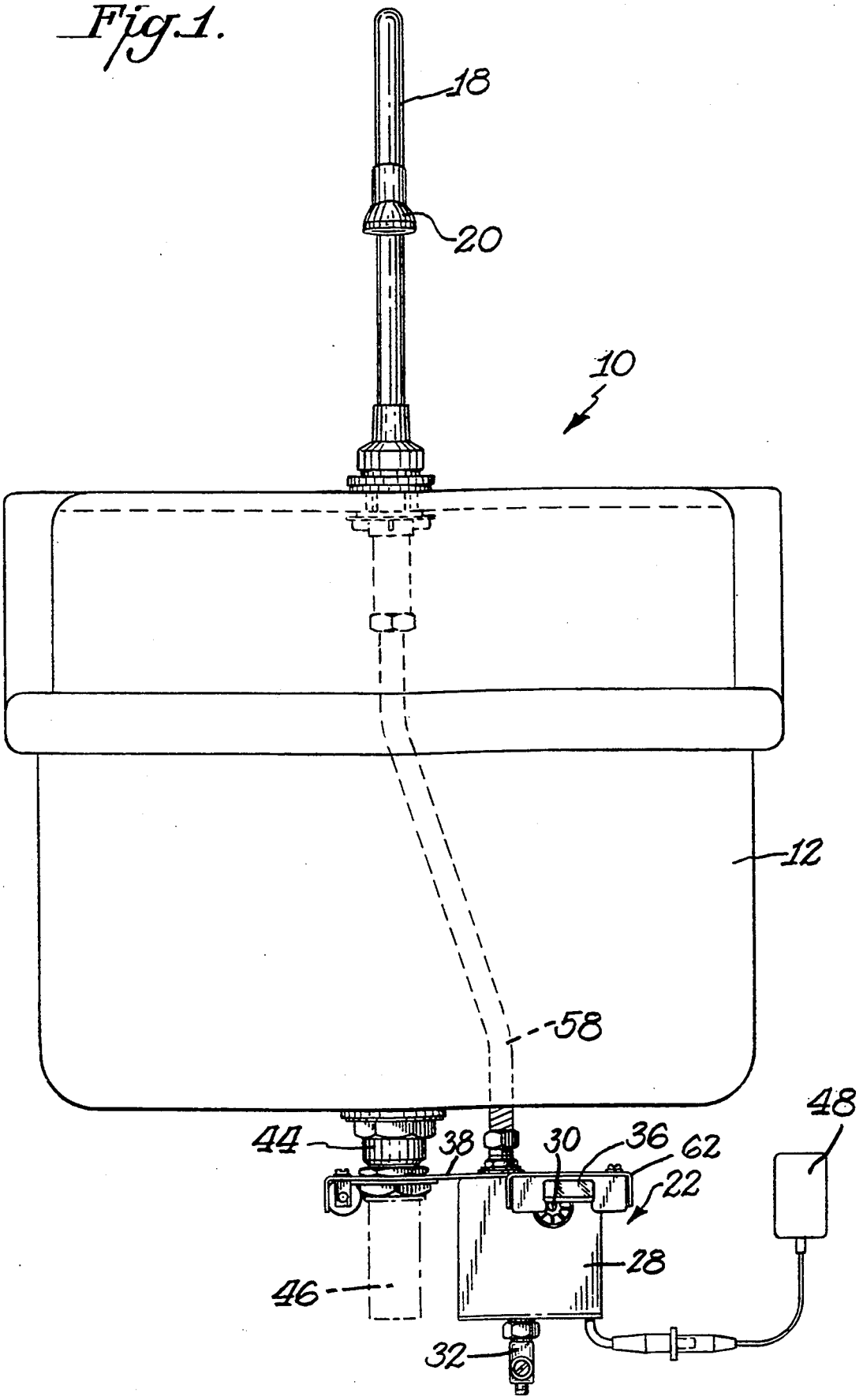
FIG. 1 is a front elevational view of a surgical scrub sink in accordance with this invention.

The present invention involves improvements over surgical scrub sinks utilizing automatic control means for turning the faucet on and off. The concepts of the invention may be practiced with various types of known surgical scrub sinks wherein the invention is incorporated therein by providing a sensor mounted at a location which would generally correspond to the legs, and more particularly the knee area, at the immediate vicinity of the sink tub. Preferably, the sensor is of short focus with a focal distance of about 2–6 inches, so as to avoid false signals which would otherwise be caused by detecting objects other than the user of the sink. The invention is based upon the recognition that when the user of the sink, such as a surgeon, is performing a hand scrubbing operation, he or she will stand immediately juxtaposed the sink tub during the scrubbing or hand washing operation and will remain in that position until the scrubbing operation is completed, although during the scrubbing operation there might be periods of time when the hands are not in the immediate vicinity of the faucet. Thus, the present invention does not rely upon detection of the hands near the faucet, but rather on the detection of the legs near the tub.

As illustrated herein a surgical scrub sink 10 is shown which includes a tub 12 of any suitable known description. The tub 12 would include a drain hole 14 at its lower portion and would include a front edge 16. A faucet 18 is mounted at the top of tub 12. The faucet 18 terminates in a nozzle 20 which is disposed over and toward the open body of tub 12.

Figure 4:
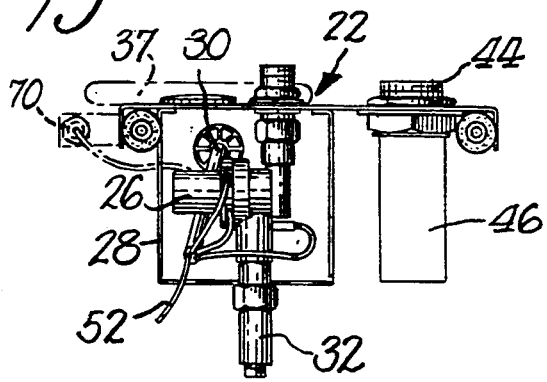
FIG. 4 is a rear elevational view of the valve assembly for the surgical scrub sink of FIGS. 1–3.

Faucet 18 is electronically operated by an on/off mechanism as known in the art. Such on/off mechanism 22 may include, for example, a solenoid controlled electronic mixing valve which, as shown in FIG. 4, includes a solenoid 26 mounted in housing 28. A sensor module cable 30 is also provided in housing 28 as well as other known components such as an in-line strainer 32.

Figure 2:
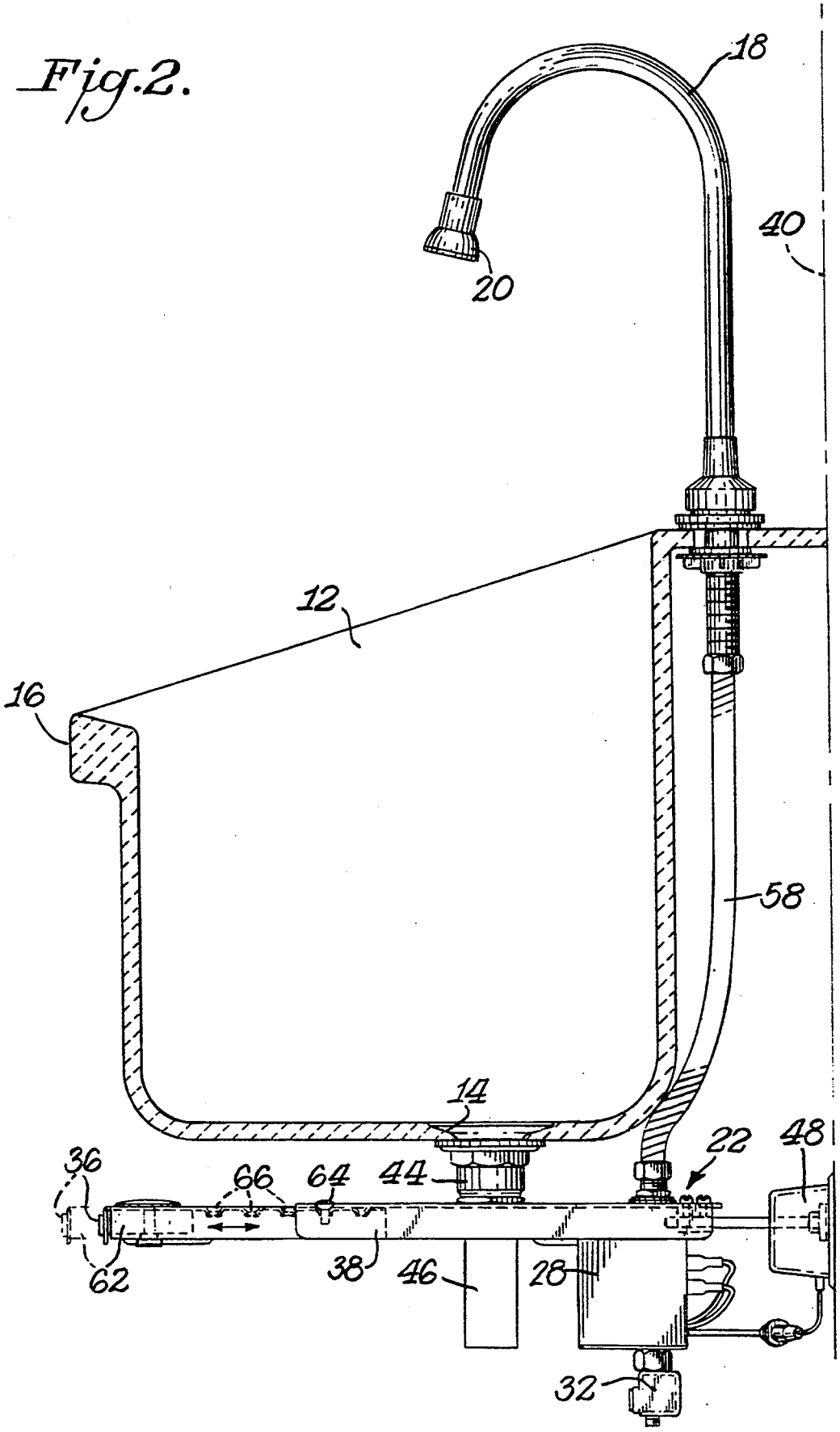
FIG. 2 is a side elevational view partly in section of the surgical .scrub sink shown in FIG. 1.
Figure 3:
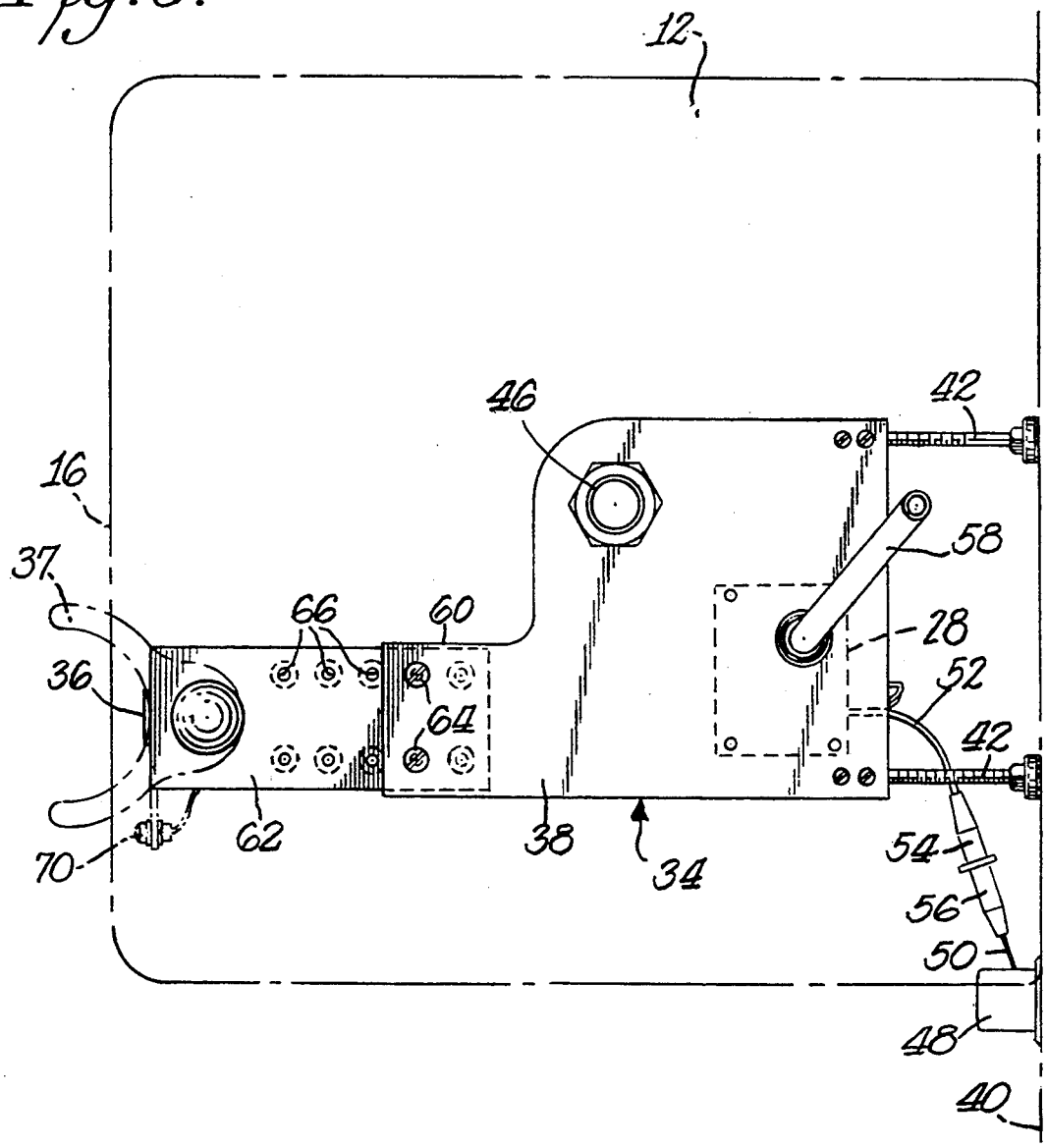
FIG. 3 is a top plan view of a portion of the surgical scrub sink shown in FIGS. 1–2.

The housing or enclosure 28 for the on/off mechanism 22 is mounted to a support arm 34. A sensor 36 is mounted to the remote or free end of support arm 34 as best shown in FIGS. 2–3. A guide means 37 shown in phantom in FIGS. 3 and 4 can optionally be positioned at the end of support arm 34 to guide the user's leg into proximity to the sensor 36 and facilitate retention of the user's leg in that position near sensor 36.

Support arm 34 includes a main bracket 38 which is fixedly mounted to any suitable support. For example, as best illustrated in FIG. 3 the main bracket 38 is attached to drain tube 44 of tub 12 and is stabilized against rotation by a pair of wall adjustment screws 42 bearing against wall 40. Screws 42 are selectively locked by top screws 22 extending through bracket 38 as illustrated in FIG. 2. Tub 12 is secured directly to wall 40.

Advantageously, support arm 34 is utilized for mounting various components of the surgical scrub sink 10. As noted, sensor 36 and on/off mechanism 28 are mounted to support arm 34. Support arm 34 is suspended from tub 12 by connection to drain tube 44 leading from drain hole 14. Tube 44 is mounted to and through support arm 34 with the tail piece 46 extending downwardly below support arm 34. As illustrated in the various figures the on/off mechanism includes a transformer 48 mounted at any suitable location, such as to wall 40. The wiring 50 for transformer 48 is electrically connected to the wiring 52 from on/off mechanism 22 by means of mating coupling members 54,56. The on/-off mechanism also includes a reinforced hose 58 fitting to faucet 18. Transformer 48 may be of any suitable known construction such as a 12 volt transformer.

Sensor cable 30 is housed within the downwardly extending sides of arm 34 and is connected to sensor 36. As shown in FIG. 3 main bracket 38 includes a narrow extension 60 into which is telescopically fitted an extender bracket 62. Extender bracket 62 may be adjustably positioned in extension 60 by selectively connecting suitable fasteners 64 through extension 60 and into corresponding holes 66 of extender bracket 62. As a result, the position of sensor module 36 could be adjusted to its intended location with respect to the front edge 16 of tub 12. This assures that the module will detect the presence or absence of the user standing in front of and at or juxtaposed to front edge 16 of tub 12. Accordingly, it is possible to use a short focus sensor having an effective focal distance of about 2–6 inches and still reliably sense the presence or absence of a surgeon standing at sink 10. The elevation of sensor 36 above the floor would be selected to correspond to the elevation of the surgeon's legs, such as in the knee area. Other locations of the surgeon's legs could also be used as the detecting target. Thus, sensor module 36 could be elevated above the floor any suitable distance of, for example, six inches to thirty inches.

A suitable short focus sensor 36 can be used. Such sensor may use a commercially available KODAK R27 Grey Card. To determine the focal distance of the photosensor, the card is moved toward the sensor until it lights.

The invention would thus be practiced by suitably positioning sensor module 36 at the desired location, generally at the front edge 16 of tub 12. Sensor module 36 would project a beam which operates in a known manner to detect the presence or absence of an object in the range of the beam. Because sensor module 36 preferably operates with a short focus the presence of an object would be detected only when the object is in the immediate vicinity of front edge 16 at the elevation of sensor module 36. Thus, under ordinary conditions no object would be detected. This detection of the absence of an object would permit the on/off mechanism 22 to remain in its off condition and no water would flow from spray nozzle 20. When, however, a surgeon steps to sink 10 in order to perform a scrubbing operation by standing at the front edge 16 of sink 10, sensor module 36 would detect the presence of an object, namely the surgeon's legs and the sensing would be transmitted to on/off mechanism 22 to actuate solenoid 26 and permit water to flow through tube 58 into faucet 18 and be discharged from spray nozzle 0. The water would continue to flow as long as the surgeon remained at the front of tub 12. The optional bracket 37 assists in retention of the surgeon's leg within the operating range of the sensor 36. There would thus be no interruption in the flow even under periods where the surgeon's hands are not in the immediate vicinity of faucet 18. Once the scrubbing operation has been completed the surgeon would step away from tub 12. Sensor 36 would then detect the absence of the surgeon and corresponding signal would be sent to solenoid 26. Flow would then terminate through faucet 18.

An optional manual override switch 70 is also provided to facilitate continued flow of water should there be an interruption in power to the solenoid 26. This override switch 70 is linked to a backup battery power pack to maintain actuation of the solenoid, and resultant flow through faucet 18, in case of a power failure.

The invention thus provides a means of automatically controlling flow of water during scrubbing which permits full movement of the surgeon's arms and hands during the scrubbing without affecting the continuous flow of water from nozzle 20. Flow would then be terminated automatically once the scrubbing is completed and the surgeon is no longer present at sink 10.

Although the invention has been particularly described with respect to a tub mounted above the floor. It is to be understood that the invention may also be practiced where the tub extends to the floor. In such practice, the sensor would be mounted to the sink at a level corresponding to the surgeon's legs when the surgeon stands at the tub during the scrubbing. In such practice of the invention the sensor could be mounted directly to, for example, the front edge of the tub, on a leg or shelf attached to the sink or built into the sink cabinet.

What is claimed is:

1. A surgical scrub sink comprising a tub mounted to a support wall and above a floor wherein said tub includes a drain hole and a drain tube connected to said drain hole, a faucet mounted over and disposed toward said tub, an electronically operated on/off mechanism including a solenoid controlled electronic mixing valve for controlling the flow of water from said faucet into said tub, a narrow beam, short focus sensor mounted on a support arm below the tub attached to the tub drain tube wherein said support arm is of elongated shape including a main bracket, an extender bracket slidably mounted to said main bracket and lockable in position for varying the effective length of said arm, and said sensor being mounted to said extender bracket, and wherein said support arm also contains adjustment screws disposed against said wall, said sensor being mounted at an elevation of from about six inches to about thirty inches above said floor and directing a beam toward the front of the tub, said sensor having a focal length of about 2–6 inches for detecting the presence and absence of a user in the immediate vicinity of said tub, and said sensor being operatively connected to said on/off mechanism for turning on said faucet when the presence of a user is detected and for tuning off said faucet when the absence of a user is detected.

2. A surgical scrub sink comprising a tub mounted on a wall wherein said tub includes a drain hole and a drain tube connected to said drain hole, a faucet mounted over and disposed toward said tub, an electronically operated on/off mechanism including a solenoid controlled electronic mixing valve for controlling the flow of water from said faucet into said tub, a narrow beam, short focus sensor mounted on a support arm attached to said tub drain tube below said tub, said support arm having adjustment screws at one end thereof for placement against said wall, said sensor being attached to the support arm near the front of the tub at an elevation of from about six inches to about thirty inches above said floor and directing a beam toward the front of the tub, said sensor having a focal length of about 2–6 inches for detecting the presence and absence of a user in the immediate vicinity of said tub, and said sensor being operatively connected to said on/off mechanism to turn on said faucet when the presence of a user is detected and for turning off said faucet when the absence of a user is detected.

* * * * *

UNITED STATES PATENT AND TRADEMARK OFFICE

CERTIFICATE OF CORRECTION

PATENT NO. : 5,412,816

DATED : May 9, 1995

INVENTOR(S) : Graham H. Paterson, et al.

It is certified that error appears in the above-indentified patent and that said Letters Patent is hereby corrected as shown below:

Column 4, line 10, "0" should read --20--.

Signed and Sealed this

Nineteenth Day of December, 1995

*Attest:*

*Attesting Officer*

BRUCE LEHMAN

*Commissioner of Patents and Trademarks*